US011333345B1

(12) United States Patent
Chen

(10) Patent No.: US 11,333,345 B1
(45) Date of Patent: May 17, 2022

(54) COMBINED POWER STRIP PLUG AND NIGHT LIGHT

(71) Applicant: SHENZHEN ANHAORUIHE ELECTRONICS CO., LTD, Shenzhen (CN)

(72) Inventor: Xinhe Chen, Shenzhen (CN)

(73) Assignee: SHENZHEN ANHAORUIHE ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 17/489,848

(22) Filed: Sep. 30, 2021

(51) Int. Cl.

| | |
|---|---|
| ***F21V 33/00*** | (2006.01) |
| ***H01R 25/00*** | (2006.01) |
| ***F21V 23/04*** | (2006.01) |
| ***F21V 23/00*** | (2015.01) |
| ***F21S 8/00*** | (2006.01) |
| ***H01R 13/717*** | (2006.01) |

(52) U.S. Cl.
CPC ..... *F21V 33/0004* (2013.01); *F21S 8/035* (2013.01); *F21V 23/007* (2013.01); *F21V 23/0485* (2013.01); *H01R 13/717* (2013.01); *H01R 25/006* (2013.01)

(58) Field of Classification Search
CPC ..... F21V 33/0004; F21V 23/007; F21V 23/0485; F21S 8/035; H01R 13/717; H01R 25/006
See application file for complete search history.

(56) References Cited

U.S. PATENT DOCUMENTS

| | | | | |
|---|---|---|---|---|
| 10,594,096 | B2 * | 3/2020 | Rahner | H01R 25/006 |
| 11,005,222 | B1 * | 5/2021 | Baldwin | H01R 27/02 |
| 11,271,351 | B1 * | 3/2022 | Chen | H01R 31/065 |

OTHER PUBLICATIONS

Hardware Design for Capacitive Touch. (Year: 2013).*

* cited by examiner

*Primary Examiner* — Vibol Tan

(57) ABSTRACT

A combined power strip plug and night light includes a plug body arranged on a power socket on an indoor wall. The plug body completely covers the power socket. The plug body includes a bottom cover, a power supply board arranged in the bottom cover, an upper cover connected with the lampshade, and a lampshade. The upper cover is fixed on the bottom cover. The power supply board is electrically connected with the power socket through a plug pin assembly. The plug pin assembly is arranged on the power supply board. A light sensor and a touch spring are arranged on the power supply board. A photosensitive transparent cover for the light sensor to receive light is arranged on the upper cover. A touch position is defined on the upper cover. The touch position is touched to trigger a touch sensing of the touch spring.

9 Claims, 4 Drawing Sheets

COMBINED POWER STRIP PLUG AND NIGHT LIGHT

TECHNICAL FIELD

The present disclosure relates to a field of electrical hardware accessories, and in particular to a combined power strip plug and night light.

BACKGROUND

In the dark night, it is necessary for a user to find a switch in the dark when turning on a lamp at night in an interior of the building, which is time-consuming and labor-intensive and brings a bad experience to the user.

On the other hand, in the prior art, there are many night lights that are configured to be arranged on a power socket for lighting. However, a design of the night lights is not simple and reasonable, and there are big hidden dangers in safety of the night lights. For example, a current night light is generally very thick and protrudes from the power socket, which not only increases an occupied space of the light night, but also make the user easy to bump into the night light and cause damage to the user. Moreover, because of a circuit structure of the night lights, the night light easily generates heat. Further, there is a possibility of leakage in the night light, so the safety of the night light needs to be improved.

For some special people, especially children and the elderly, if operation of the night light is too complicated, it is inconvenient for the elderly and children to use. If the night light is too thick, it is easy to trip the human body, which is not safe for the elderly and children to use.

SUMMARY

A purpose of the present disclosure is to solve defects and technical problems in the prior art at least to some extent, and to provide a combined power strip plug and night light. The combined power strip plug and night light has a simple appearance, is safe to use, safely and effectively protects children or the elderly, and prevents touch by mistake.

In order to solve the technical problems, the present disclosure provide a combined power strip plug and night light. The combined power strip plug and night light comprises a plug body. The plug body is arranged on a power socket arranged on an indoor wall. The plug body completely covers the power socket arranged on the indoor wall. The plug body comprises a bottom cover, a power supply board, an upper cover, and a lampshade. The power supply board is arranged in the bottom cover. The upper cover is connected with the lampshade to shield the power supply board. The upper cover is fixed on the bottom cover. The power supply board is electrically connected with the power socket through a plug pin assembly electrically connected with the power supply board. The plug pin assembly is arranged on the power supply board. A light sensor and a touch spring are arranged on the power supply board. A photosensitive transparent cover for the light sensor to receive light is arranged on the upper cover. A touch position is defined on the upper cover. The touch position is touched to trigger a touch sensing of the touch spring.

In the embodiment, considering safety factors, when the combined power strip plug and night light is installed on the power socket, the plug body covers all of outlets on the power socket, thereby preventing the elderly and children from accidentally touching the outlets and causing danger.

Moreover, since the combined power strip plug and night light comprises the light sensor and the touch spring, use safety of the combined power strip plug and night light is further improved. At the same time, the plug body completely covers the power socket, which is visually concise and beautiful. The touch position is configured to realize lighting control and is convenient for the elderly and children to operate.

Optionally, lamp beads are arranged on an outer edge of the power supply board. The lampshade is adapted to and covered on a light-emitting position of the lamp beads.

In the embodiment, arranged positions of the lamp beads makes a light-emitting area large, and light emitted by the lamp beads passes through the lampshade to emit soft illumination light.

Optionally, the power supply board is connected with a power cord. A first end of the power cord is fixed to an interior of the bottom cover by a pressing block. A second end of the power cord away from the bottom cover is connected with a power strip or at least one exterior USB interface.

In the embodiment, a length of the power cord is determined according to actual needs, so that a power supply position is shifted and safety of power supply is improved. The pressing block avoids a problem of solder joint breakage caused by pulling of the power cord.

Optionally, the plug pin assembly comprises a neutral pin, a live pin, and a ground pin. The neutral pin and the live pin are cuboid. The ground pin is cylindrical. Positioning holes are on the bottom cover. The plug pin assembly passes through the positioning holes. Shapes of the positioning holes is matched with a cross-section of the plug pin assembly.

In the embodiment, a design of the plug pin assembly satisfies power supply requirements and further improves the safety of power supply.

Optionally, a plastic non-conductive pin is arranged on a bottom portion of the bottom cover. The plastic non-conductive pin plugs into the power socket.

Optionally, the power socket comprises a first outlet and a second outlet. The plastic non-conductive pin plugs into a ground hole of the first outlet.

In the embodiment, the plastic non-conductive pin isolate the two adjacent outlets, has a function of positioning, and improves the firmness of the assembly.

Optionally, the light sensor and the touch spring are arranged on a front end of the power supply board. The light sensor and the touch spring are configured to transmit induction signals to a main control IC module. The power supply board further comprises a transformer arranged on a middle portion of the power supply board. The transformer is configured for power conversion. The plug pin assembly is arranged on a back end of the power supply board and is connected with the power cord. The power cord is a three-in-one flat wire.

In the embodiment, arranging electronic components in this way saves space, and at the same time makes an overall shape of the combined power strip plug and night light concise and safe.

Optionally, the bottom cover and the upper cover are fixed by self-tapping screws arranged at four corners of the bottom cover and the upper cover. The lampshade is fixed by connection of the bottom cover and the upper cover.

In the embodiment, the fixing method improves assembly efficiency and simplify assembly steps.

Optionally, a plurality of USB interfaces are arranged on the power supply board. The USB interfaces are evenly arranged and correspond to insert ports on the upper cover.

In the embodiment, USB interfaces are provides users with great charging convenience.

Compared with the prior art, the combined power strip plug and night light effectively solves a problem of automatic indoor lighting at night. A brightness of the combined power strip plug and night light of the present disclosure is adjusted by a variety of modes. The combined power strip plug and night light effectively memorize a mode that is chose when the light is extinguished, and there is no need to re-select the mode the next time it is turned on. An appearance of the combined power strip plug and night light is simple and beautiful, and the combined power strip plug and night light safely and effectively protect children from touching the outlets on the power socket arranged on the indoor wall.

The combined power strip plug and night light shields the power socket arranged on the indoor wall and therefore protect children from touching the outlets on the power socket.

11—touch position; 12—photosensitive transparent cover; 13—upper cover; 14—touch spring; 15—lampshade; 16—light sensor; 17, power supply board; 18—bottom cover; 19—neutral pin; 20—live pin 21—ground pin; 22—pressing block; 23—power cord; 24—self-tapping screw; 31—indoor wall; 32—power socket; 33—first ground hole; 34—neutral hole; 35—live hole; 36—second ground hole 37—plastic non-conductive round pin; 38—plug body; 41—USB interface; 43—mounting seat.

DETAILED DESCRIPTION

Specific embodiments of the present disclosure will be described in further detail below in conjunction with the accompanying drawings, so as to make technical solution of the present invention easy to understand and grasp.

The present disclosure provides a combined power strip plug and night light that is arranged on a power socket 32 arranged on an indoor wall 31 and completely covers the power socket 32. Electricity is transferred to other locations by a power cord 23 of the combined power strip plug and night light. The combined power strip plug and night light of the present disclosure has a beautiful appearance and is safe to use. It can be installed on a standard or typical power socket 32 arranged in the indoor wall 31, and the combined power strip plug and night light completely covers the power socket 32 on the indoor wall. The present disclosure also has a night light function. In addition, there are multiple modes for selecting an intensity of a brightness of the night light, which brings convenience to an action at night.

The present invention applies a traditional way of connecting a visible electric plug to the power socket on the visible indoor wall 31 to consume power through the power socket. The power socket on the indoor wall is a position in an internal space of a building (for example, a room) at which electric current is run to power electrical devices such as electrical appliances and electronic equipment. A most common type of the power socket is a 15-amp (sometimes 20-amp) duplex socket, which is configured to provide power to most small appliances, electronic products (such as TVs and home theater systems), mobile phones, portable computing devices (such as laptops and tablet), and lamps. The combined power strip plug and night light of the present disclosure can be adapted to any such power socket of this type, and the term "typical (or standard) power socket on the indoor wall 31 hereto is understood to refer to the power socket mentioned above and other similar sockets, which is not limited thereto/

Embodiment 1

Figure 1:
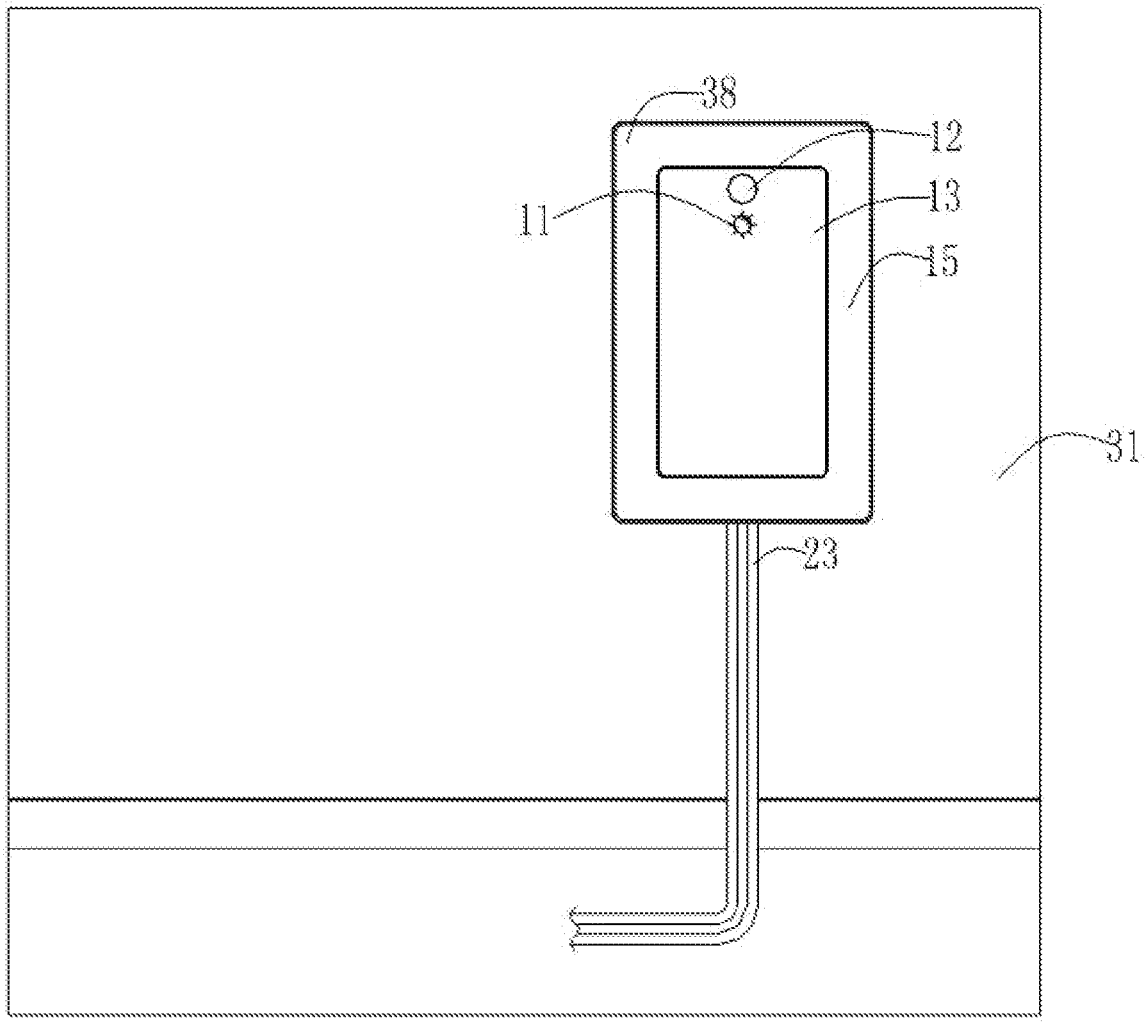
FIG. 1 is a front schematic diagram of a combined power strip plug and night light according to a first embodiment of the present disclosure, where the combined power strip plug and night light is arranged on a power socket arranged on an indoor wall.

As shown in FIG. 1, a plug body 38 of the combined power strip plug and night light is plugged into a proper position of the power socket 32 on the indoor wall 31, so the combined power strip plug and night light is arranged on the power socket 32. Characteristics of a lampshade 15, an upper cover 13 and a photosensitive transparent cover 12 are illustrated by reference to FIGS. 1 and 2.

The present disclosure provides a combined power strip plug and night light. The combined power strip plug and night light comprises a plug body 38. The plug body 38 is arranged on a power socket 32 arranged on an indoor wall 31. The plug body 38 completely covers the power socket 32 arranged on the indoor wall 31. The plug body 38 comprises a bottom cover 18, a power supply board 17, an upper cover 13, and a lampshade 15. The power supply board 17 is arranged in the bottom cover 18. The upper cover 13 is connected with the lampshade 15 to cover the power supply board 17. The upper cover 13 is fixed on the bottom cover 18. The power supply board 17 is electrically connected with the power socket 32 through a plug pin assembly electrically connected with the power supply board. The plug pin assembly is arranged on the power supply board 17. A light sensor 16 and a touch spring 14 are arranged on the power supply board 17. A photosensitive transparent cover 12 for the light sensor 16 to receive light is arranged on the upper cover 13. A touch position is defined on the upper cover. 13 The touch position is touched to trigger a touch sensing of the touch spring 14.

Lamp beads are arranged on an outer edge of the power supply board 17. The lampshade 15 is adapted to and covered on a light-emitting position of the lamp beads. The power supply board 17 is connected with a power cord 23. A first end of the power cord 23 is fixed to an interior of the bottom cover 18 by a pressing block. A second end of the power cord 23 away from the bottom cover 18 is connected with a power strip or at least one exterior USB interface. The power cord is a three-in-one flat wire. The Power cord 23 passes through a elliptical hole on the bottom cover 18 and is connected to the power strip or at least one exterior USB interface. A size of the power cord ranges from 3-10 feet.

Figure 2:
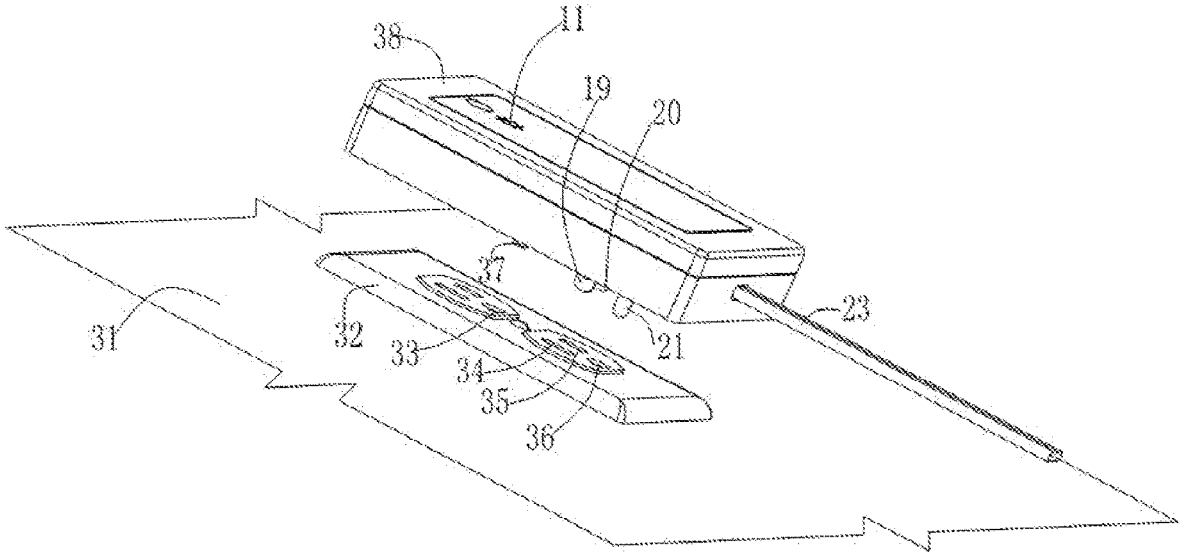
FIG. 2 is a perspective schematic diagram of the combined power strip plug and night light according to the first embodiment of the present disclosure, where the combined power strip plug and night light is separated from the power socket arranged on the indoor wall.
Figure 3:
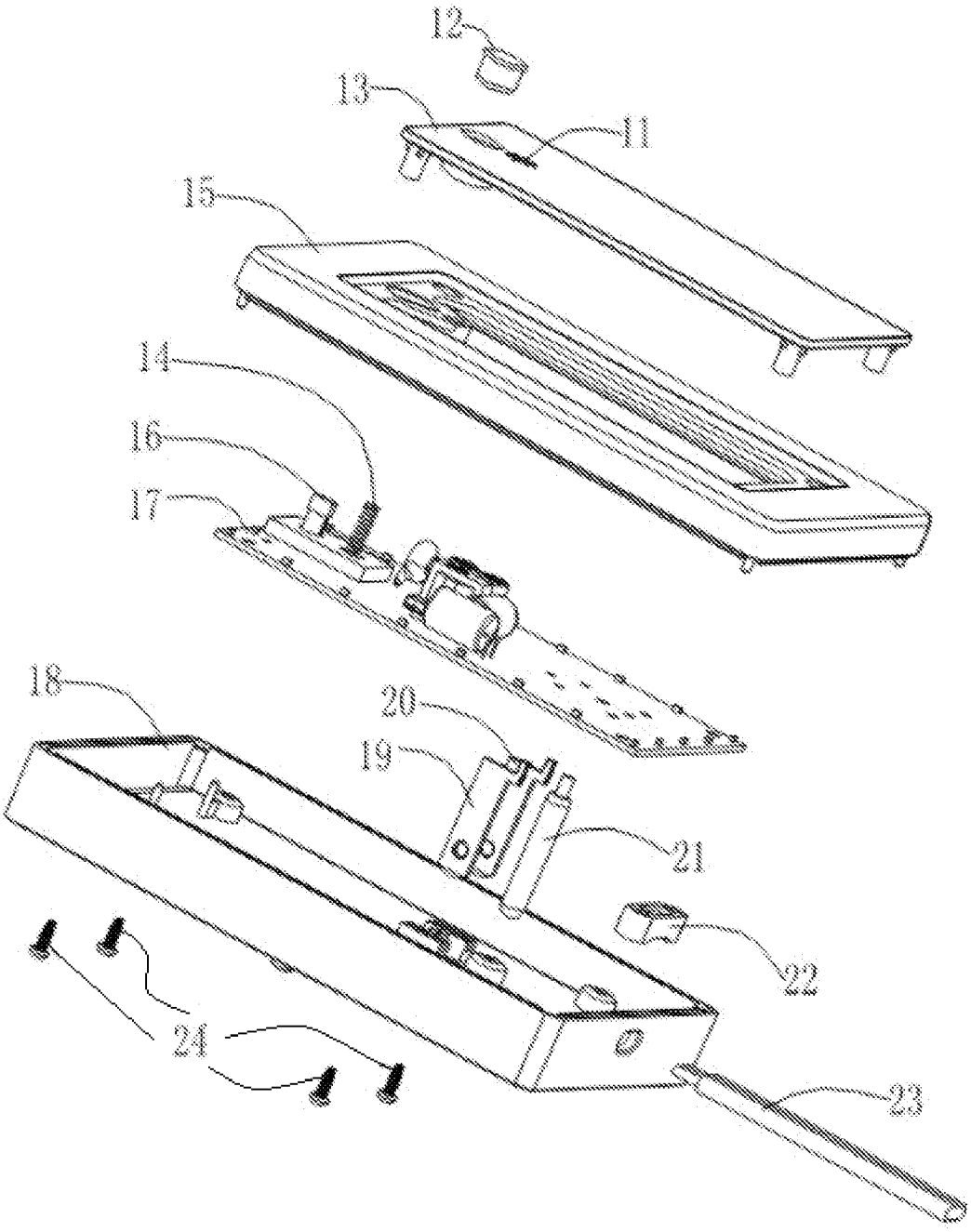
FIG. 3 is an exploded schematic diagram of the combined power strip plug and night light according to the first embodiment of the present disclosure.
Figure 4:
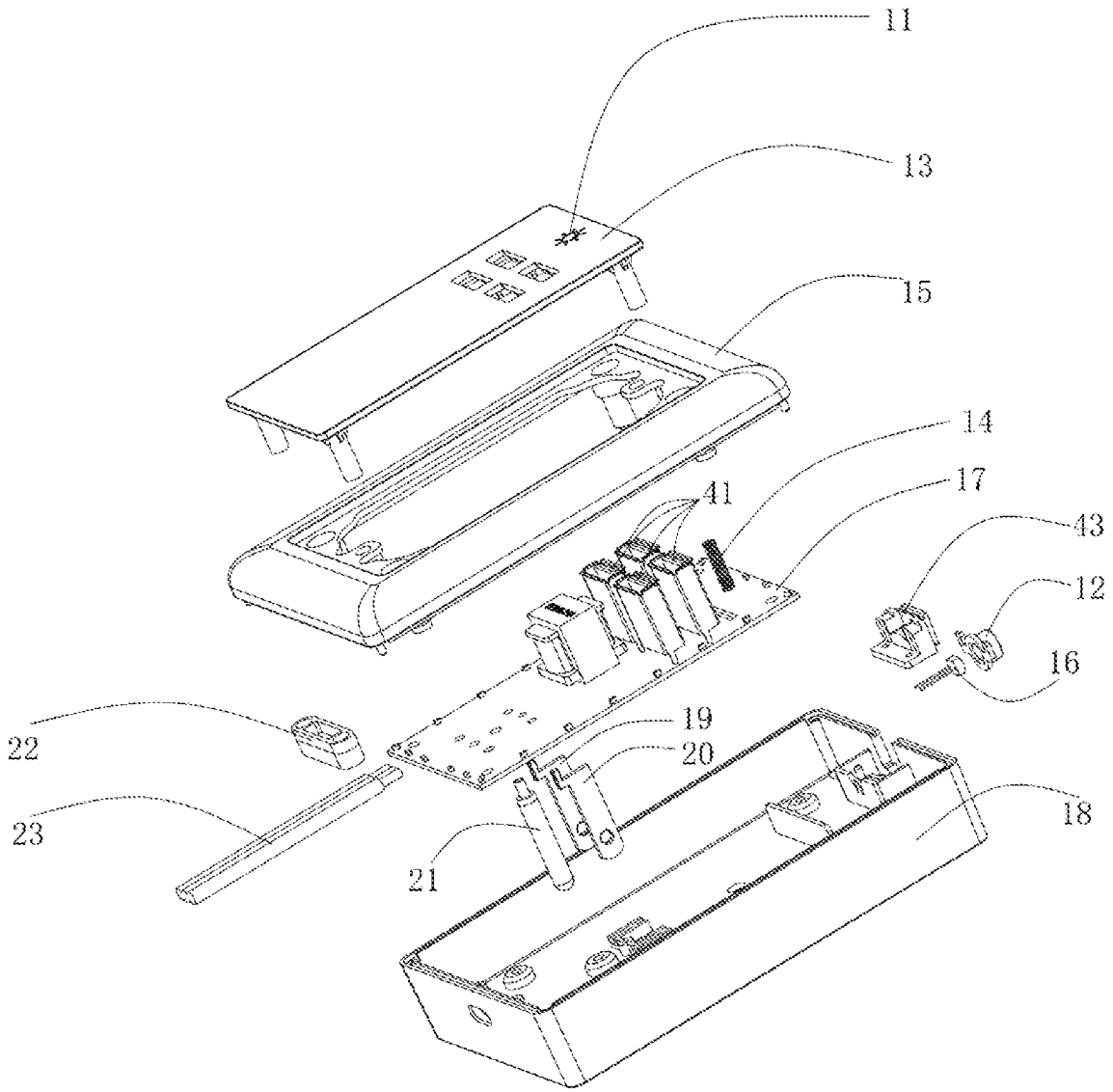
FIG. 4 is an exploded schematic diagram of the combined power strip plug and night light according to a second embodiment of the present disclosure.

As shown in FIG. 2, the plug pin assembly comprises a neutral pin 19, a live pin 20, and a ground pin 21. The neutral pin 19 and the live pin 20 are cuboid. The ground pin 21 is cylindrical. Positioning holes are on the bottom cover 18. The plug pin assembly passes through the positioning holes. Shapes of the positioning holes is matched with a cross-section of the plug pin assembly. A plastic non-conductive pin 37 is arranged on a bottom portion of the bottom cover 18. The plastic non-conductive pin 37 plugs into the power socket 32. The power socket 32 comprises a first outlet and a second outlet. The first outlet comprises a first ground hole 33, and the second outlet comprises a neutral hole 34, a live hole 35, and a second ground hole 36. The plastic non-conductive pin 37 plugs into the first ground hole 33 of the first outlet. The light sensor 16 and the touch spring 14 are arranged on a front end of the power supply board 17. The light sensor 16 and the touch spring 14 are configured to transmit induction signals to a main control IC module. The power supply board further comprises a transformer arranged on a middle portion of the power supply board. The transformer is configured for power conversion. The plug pin assembly is arranged on a back end of the power supply board and is connected with the power cord. The power cord is a three-in-one flat wire. The bottom cover 18 and the upper cover 13 are fixed by self-tapping screws 24 arranged at four corners of the bottom cover 18 and the upper cover 13. The lampshade 15 is fixed by connection of the bottom cover 18 and the upper cover 13.

A further explanation of the above structure is as follows:

The lampshade 15 of the present disclosure is a light-transmitting component. Optionally, the lampshade 15 has a width of 0.5 inches. The upper cover 13 is an opaque backlight plate arranged between the lampshade 15 and the bottom cover 18. The light sensor 16 is arranged at a front end of the upper cover 13, of which transmits light simply, quickly and effectively. The touch spring 14 is a smart switch arranged near the light sensor 16. By touching the smart switch, an intensity of light emitted by surrounding lamp beads is effectively controlled, or the lamp beads are turned off directly.

The power supply board 17 is a printed circuit board (PCB) arranged in the interior of the combined power strip plug and night light. The lamp beads are arranged on the outer edge of the PCB and are configured to provide the light source. The light sensor 16 is arranged on the front portion of the PCB. The light sensor 16 quickly transmits a light signal to the main control IC module of the PCB, so as to control a working state of the lamp beads and control the lamp beads to turn on or turn off. The touch spring 14 is arranged near the light sensor 16. Through the touch spring 14, the main control IC module is triggered to control the intensity of the brightness of the lamp beads. The transformer is arranged on the middle portion of the PCB, of which converts high voltage to low voltage to provide energy for the lamp beads. The plug pin assembly providing mains supply is arranged on the back end of the PCB. The neutral pin 19, the live pin 20, and the ground pin 21 are connected to the PCB by soldering. The positioning holes are three circular holes on the end of the PCB. A neutral wire, a live wire, and a ground wire of the power cord respectively pass through the respective circular hole to connected with the PCB by soldering. Thus, the neutral wire, the live wire, and the ground wire of the power cord are respectively connected to the neutral pin, the live pin, and the ground pin of the plug pin assembly. Therefore, the power socket 32 is connected to the exterior power strip through the power cord.

The bottom cover 18 is arc-shaped and completely covers the power socket 32 on the indoor wall 31. The plug pin assembly includes the neutral pin, the live pin and the ground pin. The three plug pins correspond to the second outlet of the power socket. In addition, the present disclosure also comprises the plastic non-conductive pin, which is corresponding to the first ground hole of the power socket 32. The elliptical hole is on the bottom portion of the arc-shaped bottom cover 18. The first end of the power cord is welded to the PCB, and the second end of the power cord passes through the elliptical hole to connect with the external power strip or USB interfaces.

In an overall assembly process of the present disclosure, the neutral pin 19, the live pin 20 and the ground pin 21 are installed on the bottom cover 18, and then the power supply board 17 with the power cord 23 welded on it is placed in the bottom cover 18. Then the pressing block 22, the lampshade 15, the upper cover 13, and the photosensitive transparent cover 12 are installed in sequence. Finally the four self-tapping screws 24 are installed to completed the installation of the combined power strip plug and night light.

The combined power strip plug and night light is plugged into the power socket on the indoor wall. When the indoor light is very dark, the combined power strip plug and night light will automatically emit light, play a role of lighting, and provide a light source for users who are moving in the dark. For example, the combined power strip plug and night light provides the light source for children playing at night to avoid bumps caused by children who are too dark to see a surrounding environment, so as to ensure safety.

The combined power strip plug and night light of the present disclosure is a perfect combination of plug and night light. The appearance is simple, generous and beautiful. At the same time, the combined power strip plug and night light has a memory function and would not change the mode determined by the user when light is temporarily extinguished due to the power is sudden shut off or the external light is excessive. When the combined power strip plug and night light is plugged into the power socket on the indoor wall 31, the lamp beads glow for a few seconds and then go out during the day, and the lamp beads always be in a luminous state at night. At night, by taping lightly with the user's finger on the touch position, the brightness of the lamp beads is adjusted. The user is able to choose different brightness according to their needs.

Embodiment 2

Differing from Embodiment 1, in the Embodiment 2, multiple USB interface 41 are provided to provide power. Optionally, a plurality of USB interfaces 41 are arranged on the power supply board 17. The USB interfaces are neatly arranged and correspond to insert ports on the upper cover.

In the embodiment, USB interfaces are provides users with great charging convenience. The light sensor 16 is installed in the photosensitive transparent cover 12 and installed on a mounting seat 43 to improve firmness of structural installation and reliability of photosensitive.

Of course, the above are only typical embodiments of the present disclosure. In addition, the present disclosure further comprises other various specific embodiments. All technical solutions formed by equivalent substitutions or equivalent transformations fall within the protection scope of the present disclosure.

What is claimed is:

1. A combined power strip plug and night light, comprising: a plug body; the plug body is arranged on a power socket arranged on an indoor wall; the plug body completely covers the power socket arranged on the indoor wall;

wherein the plug body comprises a bottom cover, a power supply board, an upper cover, and a lampshade; the power supply board is arranged in the bottom cover; the upper cover is connected with the lampshade to shield the power supply board; the upper cover is fixed on the bottom cover; the power supply board is electrically connected with the power socket through a plug pin assembly electrically connected with the power supply board; the plug pin assembly is arranged on the power supply board; a light sensor and a touch spring are arranged on the power supply board; a photosensitive transparent cover for the light sensor to receive light is arranged on the upper cover; a touch position is defined on the upper cover; the touch position is touched to trigger a touch sensing of the touch spring.

2. The combined power strip plug and night light according to claim 1, wherein lamp beads are arranged on an outer edge of the power supply board; the lampshade is adapted to and covered on a light-emitting position of the lamp beads.

3. The combined power strip plug and night light according to claim 1, wherein the power supply board is connected with a power cord; a first end of the power cord is fixed to an interior of the bottom cover by a pressing block; a second end of the power cord away from the bottom cover is connected with a power strip or at least one exterior USB interface.

4. The combined power strip plug and night light according to claim 1, wherein the plug pin assembly comprises a neutral pin, a live pin, and a ground pin; the neutral pin and the live pin are cuboid; the ground pin is cylindrical; positioning holes are on the bottom cover; the plug pin assembly passes through the positioning holes; shapes of the positioning holes are matched with a cross-section of the plug pin assembly.

5. The combined power strip plug and night light according to claim 1, wherein a plastic non-conductive pin is arranged on a bottom portion of the bottom cover; the plastic non-conductive pin plugs into the power socket.

6. The combined power strip plug and night light according to claim 5, wherein the power socket comprises a first outlet and a second outlet, the plastic non-conductive pin plugs into a ground hole of the first outlet.

7. The combined power strip plug and night light according to claim 1, wherein the light sensor and the touch spring are arranged on a front end of the power supply board; the light sensor and the touch spring are configured to transmit induction signals to a main control IC module; the power supply board further comprises a transformer arranged on a middle portion of the power supply board; the transformer is configured for power conversion; the plug pin assembly is arranged on a back end of the power supply board and is electrically connected with the power cord; the power cord is a three-in-one flat wire.

8. The combined power strip plug and night light according to claim 1, wherein the bottom cover and the upper cover are fixed by self-tapping screws arranged at four corners of the bottom cover and the upper cover; the lampshade is fixed by connection of the bottom cover and the upper cover.

9. The combined power strip plug and night light according to claim 1, wherein a plurality of USB interfaces are arranged on the power supply board; the USB interfaces are evenly arranged and correspond to insert ports on the upper cover.

* * * * *